US005084682A

United States Patent [19]

Swenson et al.

[11] Patent Number: 5,084,682

[45] Date of Patent: Jan. 28, 1992

[54] CLOSE-COUPLED RF POWER SYSTEMS FOR LINACS

[75] Inventors: Donald A. Swenson, San Diego, Calif.; William J. Hoffert, Albquerque, N. Mex.

[73] Assignee: Science Applications International Corporation, San Diego, Calif.

[21] Appl. No.: 594,587

[22] Filed: Oct. 9, 1990

Related U.S. Application Data

[63] Continuation-in-part of Ser. No. 579,114, Sep. 7, 1990, abandoned.

[51] Int. Cl.[5] ..... H01J 23/00

[52] U.S. Cl. ..... 328/233; 328/227; 315/5.41

[58] Field of Search ..... 328/233, 227; 315/541, 315/39; 333/125, 230

[56] References Cited

U.S. PATENT DOCUMENTS

| | | | |
|---|---|---|---|
| 4,211,954 | 7/1980 | Swenson | 315/5.41 |
| 4,485,346 | 11/1984 | Swenson et al. | 328/233 |
| 4,707,668 | 11/1987 | Hoffert | 330/56 |
| 4,906,896 | 3/1990 | Swenson | 315/5.41 |
| 4,992,744 | 2/1991 | Fujita et al. | 328/233 |

OTHER PUBLICATIONS

Seely, "Tuned Potential Amplifiers", *Electron-Tube Circuits*, 2nd Edition, McGraw-Hill Book Company, pp. 338-339 (1958).

Manca, et al., "High Energy Accelerating Structures for High Gradient Proton Linac Applications", *IEEE Transactions on Nuclear Science*, vol. NS-24, No. 3, Jun. 1977.

Swenson, "PIGMI: A Pion Generator for Medical Irradiations", *Los Alamos National Laboratory*, Feb. 1981.

Eimac, *Technical Data*, YU-141 Planar Triode, Salt Lake City, Utah Feb. (1988).

Swenson, et al., "A Compact 1-MeV Deuteron RFQ Linac", *European Particle Accelerator Conference*, Rome, Italy (Jun. 1988).

*Primary Examiner*—Sandra L. O'Shea
*Assistant Examiner*—Nimeshkumar D. Patel
*Attorney, Agent, or Firm*—Fitch, Even, Tabin & Flannery

[57] ABSTRACT

A close-coupled rf power system provides high peak rf power for a linear accelerator, or "linac", and other charged particle systems. The linac operates in a vacuum housing. Low level rf power is coupled inside of the vacuum housing by a conventional rf feedthrough connector. An input resonator cavity mounts on the side of the linac within the vacuum housing. The resonator cavity couples rf power to one or more amplifier assemblies, each including at least one planar triode mounted directly on the linac housing, proximate one end of the resonator cavity. The planar triode, in turn, generates a high power rf current at its respective anode. The high power rf current couples to the linac through a conductive loop operating at the anode potential. Anode cooling is provided by pumping a suitable fluid, such as de-ionized water, through the conductive loop. The high power rf current in the loop generates magnetic fields in the linac required for its operation. After passing through the loop, the rf current is shunted to ground through an integral rf-bypass capacitor. Many components of conventional rf power systems, such as rf output resonators, transmission lines, and vacuum windows, are not needed. Peak rf power of up to 1 megawatt is achievable by using clusters of planar triodes in each amplifier assembly, and by using multiple amplifier assemblies.

33 Claims, 7 Drawing Sheets

CLOSE-COUPLED RF POWER SYSTEMS FOR LINACS

This application is a continuation-in-part of application Ser. No 07/579,114, filed 9/7/90, now abandoned.

BACKGROUND OF THE INVENTION

The present invention relates to linear accelerators ("linacs") and electromagnetic focusing systems used with such linacs. More particularly, the invention relates to rf power systems for generating and delivering the high peak rf powers required by such linacs for acceleration of charged particle beams, or by such focusing systems for focusing such charged particle beams.

High-strength radio frequency (rf) electromagnetic fields, bounded by resonant cavities, are commonly used in particle accelerator systems to accelerate, focus, and/or deflect charged particle beams. The rf power required to sustain the electromagnetic fields in such resonant cavities is traditionally obtained from external rf power sources connected to the resonant cavities through some sort of rf power transmission line and rf power coupling devices. As such particle accelerators most always require vacuum conditions within the accelerating, focusing, or deflecting structure, rf windows must also be employed to couple the externally-generated high rf power into the vacuum assembly.

Unfortunately, such distributed systems, utilizing high power external rf generators, resonant cavities, high power transmission lines, couplers, windows, and the like are unnecessarily complex and expensive. Their use causes the overall cost and complexity of charged particle accelerator systems to be significantly increased, making such systems too expensive and complex to be viable for many medical, industrial, defense, or scientific applications that could otherwise make good use of accelerated, focused or deflected charged particles. What is needed, therefore, is a reduction in the cost and complexity of these systems so that particle accelerator, focusing or deflector systems (hereafter "charged particle systems") would be more viable for the many and varied medical, industrial, defense, or scientific applications that accelerate, focus, and/or deflect charged particle beams. The present invention advantageously addresses this and other needs.

SUMMARY OF THE INVENTION

In accordance with one aspect of the present invention, a close-coupled rf (CCRF) power system is provided for use with linear accelerators ("linacs"), e.g., radio frequency quadrupole (RFQ) linacs, drift tube linacs (DTL), coupled cavity linacs (CCL), or other charged particle systems. Advantageously, the CCRF power system herein described provides a small compact, integrated, efficient, and cost effective means for generating the high peak rf power required by such linacs for acceleration, focusing and/or deflection of charged particle beams up to frequencies of 2 GHz. As used herein, the term "close-coupled" or "closely-coupled" refers to close physical and electrical coupling that provides optimum coupling of power into the linac.

When used with an RFQ linac, the CCRF power system herein disclosed could include four CCRF power amplifiers, one for each quadrant of the RFQ linac. The RFQ linac operates in a vacuum housing. The CCRF power amplifiers utilize planar tubes as the rf power source. These planar tubes may be, e.g., triode tubes ("triodes"), tetrode tubes ("tetrodes"), or pentode tubes ("pentodes"). These tubes are mounted directly on the linac housing and are designed for operation in the vacuum housing. This configuration advantageously eliminates the need for many components of conventional rf power systems, such as rf output resonators, transmission lines, and vacuum windows. The amount of output power delivered by each CCRF power amplifier is advantageously controllable by designing each power amplifier to include one, two, or more triodes, tetrodes, or pentodes. There are thus four, eight, or more tubes that may advantageously be utilized in the design of the CCRF power system in order to provide a desired power level for the RFQ linac. Other types of linacs may use even larger clusters of tubes to achieve a desired power level. Peak rf power in the range of, e.g., 0.8-1.0 megawatts (MW) is readily achievable using the present invention.

Yet another aspect of the invention provides that the planar triodes or other tubes of the CCRF power system operate in a particular grounded-grid configuration that provides an rf by-pass capacitor for the high rf currents flowing through the power amplifier. Such configuration allows the CCRF power amplifier to be extremely compact and efficient. This is because the high rf currents, present at the anode of the triode or other tube, are coupled from an anode cap of the tube through a conductive loop to an anode ring, surrounding the anode cap. The conductive loop protrudes into a desired quadrant or zone of the linac (or other charged particle system) in conventional manner. The high rf currents flowing through such conductive loops generate large magnetic fields within the linac for triggering the desired mode of operation. Both the anode ring and the anode cap operate at the anode potential of the tube. The anode ring is insulated with a teflon cup, and mounted to the RFQ housing, which housing is grounded and also connected to the grid of the tube. The anode ring, at a high rf anode potential, and the RFQ housing, at constant ground potential, are thus separated by an electrical insulator, e.g., teflon. These components form a capacitor that forms an integral part of the CCRF power amplifier. This integral capacitor functions as an rf by-pass capacitor, advantageously providing an electrical return path through which the high rf currents pass after traversing the conductive loop.

A further aspect of the invention provides that the conductive loops, which couple the high rf currents into the linac, or other charged particle structure, e.g., a portion of each quadrant of an RFQ linac, are made from copper (or other conductive) tubing. Hence, a cooling liquid, such as de-ionized water, may be readily passed through this tubing in order to advantageously provide anode cooling.

One embodiment of the present invention may be characterized as an rf power amplifier for use with a charged particle system, e.g., an RFQ linac. The power amplifier includes: (1) a resonating cavity made from a resonating tube, the resonating tube having means near a first end thereof for receiving an input rf signal at a first power level; and (2) an amplifier assembly attached to a second end of the resonating tube, the amplifier assembly being optionally coupled to the linear accelerator for coupling power thereinto. The amplifier assembly comprises: (a) a body block having a bore therethrough, (b) means housed within the body block for generating a high power electrical current synchronized with the input rf signal, and (c) conductor means for providing a signal and return path for the high power electrical current into and out of the charged particle system (CPS). The high power electrical current generates a magnetic field within the linear accelerator, and the magnetic field provides, at least in part, the means for powering the CPS.

Another embodiment of the present invention may be characterized as a system for providing rf power to a linear accelerator or other CPS. The linear accelerator with which the rf power system is used is positioned within a vacuum housing. The rf power system includes: (1) rf generator means external to the vacuum housing for generating an rf signal at a first power level, this first power level being less than approximately 2 kilowatts (kw); (2) means for coupling the rf signal at the first power level to a location inside of the vacuum housing; and (3) power amplifier means internal to the vacuum housing for receiving the rf signal at the first power level, amplifying it to a second power level, and delivering the amplified rf signal at the second power level to the linear accelerator. In accordance with this embodiment, the power amplifier means is in close electrical and physical proximity to the linear accelerator.

Further, the invention may be viewed as a method of coupling rf high power to a linear accelerator or similar charged particle system. The linear accelerator (or other charged particle system) is housed within a vacuum housing. The method includes the steps of: (a) mounting at least one triode tube in close physical and electrical proximity to the linear accelerator within the vacuum housing; (b) connecting an anode of the at least one triode tube to a high voltage potential and to a first end of a conductor formed in a loop; (c) connecting a second end of the conductor to one side of a capacitor, and connecting the other side of the capacitor to ground; (d) connecting a grid of the at least one triode tube to ground; (e) biasing a cathode of the at least one triode tube to a prescribed potential; (f) positioning the loop of the conductor within a desired region of the linear accelerator so that an electrical current flowing through the conductor generates a magnetic field within the linear accelerator of a desired polarity; (g) generating a low level rf power signal external to the vacuum housing; (h) coupling the low level rf power signal into the vacuum housing through an rf signal feedthrough connector; and (i) driving the cathode of the at least one triode tube with the low level rf power signal. In this fashion, a high power rf electrical current is generated that flows from the anode of the at least one triode tube through the conductor and capacitor to ground, inducing a high power magnetic field that powers the linear accelerator.

It is a feature of the present invention to provide a very compact source of rf power for accelerator applications.

It is another feature of the invention to provide such a source of rf power that can operate at high frequencies, e.g., up to 2 GHz.

It is still another feature of the invention to provide such a compact, high frequency source of rf power for accelerator applications that utilizes few parts, is lightweight, is economical to manufacture, and simple to operate.

It is yet another feature of the invention to provide a compact source of rf power for use with linear accelerators that operates in a reliable, grounded-grid configuration.

It is an additional feature of the invention to provide such a compact source of rf power that is efficient to operate, with a portion of the input power applied thereto ending up as part of the output power.

A further feature of the invention provides a compact rf power amplifier for accelerator applications that is zener-diode biased.

Yet another feature of the invention provides such a compact rf power amplifier that utilizes the accelerator cavity as the rf output cavity, and thus does not require the design of a custom rf cavity at the design frequency for this purpose. A related feature of the invention provides such a dual rf output and accelerator cavity wherein the rf fields present in such cavity make only minor, and mostly insignificant, perturbations in the accelerator cavity fields.

Still an additional feature of the invention provides a compact rf power amplifier wherein the majority of the components utilized in the amplifier may be designed to be independent of the operating frequency, with only an input cavity, detachably mounted to the accelerator cavity, being tailored to the design frequency.

A further feature of the invention provides an rf power system for use with a linac that requires only a standard flexible coaxial cable, e.g., RG-8, to deliver the rf input power to the system, and that utilizes a standard coaxial connector, e.g., a Type N connector, as a vacuum feedthrough. Thus, the system of the invention does not require the use of expensive, cumbersome waveguides nor vacuum windows, as required in the prior art, in order to couple rf power to the accelerator.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION OF THE INVENTION

The following description includes the best mode presently contemplated for carrying out the invention. This description is not to be taken in a limiting sense, but is made merely for the purpose of describing the general principles of the invention. The scope of the invention should be determined with reference to the claims.

As has been indicated, the close-coupled rf ("CCRF") power system described herein is preferably used to power an RFQ linac. However, while powering an RFQ linac is the preferred application for the invention, and is thus the embodiment described herein, it is to be understood that the CCRF power system also has applicability to powering other types of linear accelerators, deflectors, rf lenses, and other charged particle systems, in addition to RFQ linacs. Indeed, any device requiring a high power rf current to set up a desired electromagnetic mode within the device may benefit from the CCRF power system herein described.

Figure 1A:
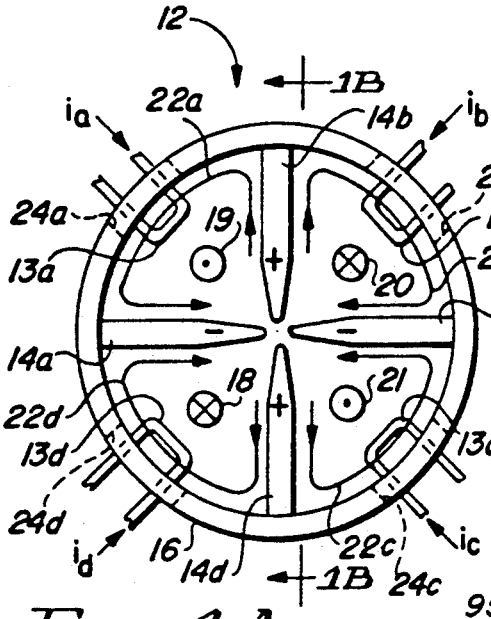
FIG. 1A is an end view of an RFQ linac, and illustrates how a first current flowing in a current loop in each quadrant of the RFQ linac generates a magnetic field that, in combination with the other magnetic fields thus generated, induces a second current to flow in each vane that charges the respective vane tip to a desired charge potential.
Figure 1B:
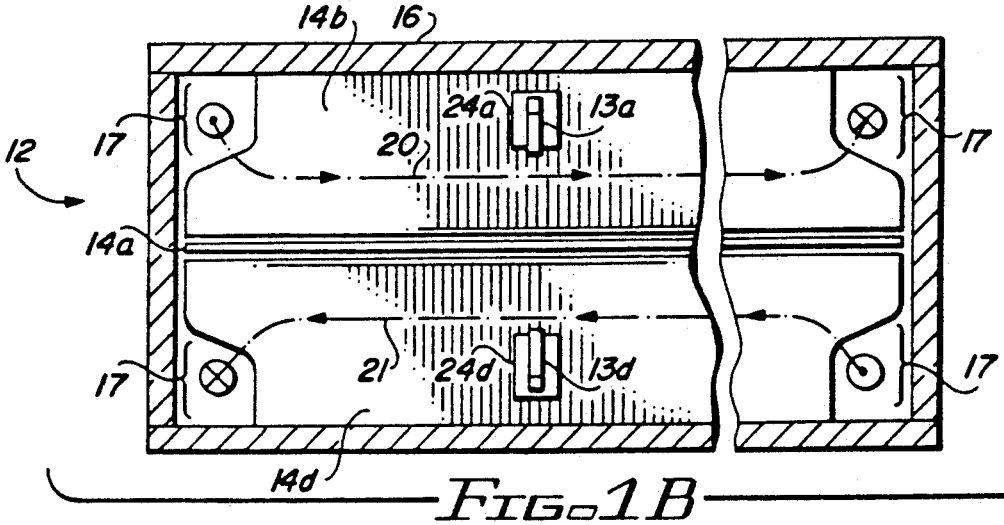
FIG. 1B is a sectional view taken along the sectional line 1B—1B of FIG. 1A, as viewed in the direction of the arrows on the sectional line, and schematically illustrates how the flux path of the magnetic field wraps around the end of the vanes.

To better understand and appreciate the features, advantages and use of the present invention, it will be helpful to briefly review the operation of an RFQ linac. Accordingly, reference is made to FIGS. 1A and 1B where the manner in which an RFQ linac is powered is illustrated. FIG. 1A is an end view of an RFQ linac 12. FIG. 1B is a sectional view taken along the sectional line 1B—1B of FIG. 1A.

As seen in FIG. 1A, the RFQ linac utilizes four facing vanes or poles, 14*a*, 14*b*, 14*c*, and 14*d*, spaced 90° apart (when viewed transversely, as in FIG. 1A), mounted to a vane housing 16. (The vane housing 16 is shown in FIG. 1A as a round cylinder. However, it is to be understood that other configurations may also be used, e.g., a square or an octagon.) Each of the vanes 14*a*, 14*b*, 14*c*, and 14*d* has increasingly spaced-apart, longitudinal serrations (not shown in FIG. 1B) along their facing edges ("tips"). These serrations are offset. That is, a "peak" of the serrations of the vanes 14*a* and 14*c*, is located at a longitudinal position along the length of the vane corresponding to a "valley" of the serrations of vanes 14*b* and 14*d*, and vice versa.

In operation, the vane tips are alternatively charged to a positive and negative potential in order to "push and pull" (through attractive and repulsive electrostatic forces) a charged particle through the narrow region surrounded by the vane tips. The frequency at which the alternating charge is applied to the vanes remains constant, but the distance between adjacent peaks of the serrations increases. Hence, a charged particle moving through the accelerator must accelerate in order to cover an increasingly longer distance (the distance between adjacent peaks of the serrations) in the same amount of time (the period of the oscillating signal). For a more complete description of an RFQ linac, both a conventional four vane RFQ linac, and a four-finger variation thereof, see applicant's earlier U.S. patent application Ser. No. 07/554,797, filed 07/18/90, assigned to the same assignee as this application, which application is incorporated herein by reference.

FIG. 1A illustrates the manner in which respective alternating electrical currents $i_a$, $i_b$, $i_c$ and $i_d$, flowing in respective current loops 13*a*, 13*b*, 13*c*, and 13*d* in each quadrant of the RFQ linac, generate a magnetic field for powering the linac. A magnetic field is generated around a current-carrying conductor in accordance with well known electromagnetic principles. The direction of the magnetic field may readily be determined by using the "right hand rule". In accordance with the right hand rule, the thumb of the right hand is pointed in the direction of the current in the conductor (flowing from positive to negative potential) and the fingers then curl around the conductor in the direction of the magnetic field. The magnetic field generated by the currents $i_a$, $i_b$, $i_c$, and $i_d$ is perpendicular to the plane of FIG. 1A, and parallel to the plane of FIG. 1B, except near the ends of the vanes. (At the ends of the vanes, the magnetic flux lines associated with the magnetic field wrap around the vanes through cutout regions 17.)

The magnetic field is represented schematically in FIGS. 1A and 1B by magnetic flux lines 18, 19, 20 and 21 in each quadrant of the RFQ linac. Where the flux line is perpendicular to the plane of the paper, it is represented by a cross in a circle, "⊕", when the magnetic flux line flows into the plane of the paper; and the flux line is represented by a dot in a circle, "⊙", when the magnetic flux line flows out of the plane of the paper.

The total magnetic flux in any given quadrant of the RFQ linac results from a combination of the magnetic flux in the adjacent quadrants. That is, magnetic flux flowing into the paper in FIG. 1A, e.g., the flux identified by the reference numeral 18, splits approximately equally (by wrapping around the ends of the vanes 14*a* and 14*d* in the cutout regions 17) between the flux flowing out of the paper as indicated by the reference numerals 19 and 21. Similarly, the magnetic flux flowing into the paper identified by the reference numeral 20 also splits approximately equally between the flux flowing out of the paper as indicated by the reference numerals 19 and 21.

It will be appreciated that the magnetic fields generated by the currents $i_a$, $i_b$, $i_c$ and $i_d$, change polarity at the same rates as the rf currents change polarity (direction). Hence, the magnetic flux lines 18–21 21 in FIGS. 1A and 1B only represent the magnetic field at one instant of time, i.e., when the currents $i_a$, $i_b$, $i_c$ and $i_d$, are at their respective peak values with the polarity (direction) shown in FIG. 1A. As these currents are alternating currents, alternating at a high rf frequency, the magnetic fields also alternate in polarity at this same rf frequency. In accordance with well known electromagnetic principles, i.e., Farady's law, these changing magnetic fields induce electrical currents flowing around the edge of each quadrant, as seen in FIG. 1A. These induced electrical currents, hereafter "quadrant currents", are schematically represented in FIG. 1A by the arrows *22a*, *22b*, *22c*, and *22d*. These quadrant currents combine to place an electrical charge of a desired polarity on the tip of each vane. These electrical charges, in turn, allow the linac to perform its accelerating function, as described previously.

Thus, in summary, the RFQ linac is powered by applying alternating currents to respective current loops that transversely protrude into each quadrant of the RFQ linac. These currents set up alternating magnetic fields within the linac, having flux lines substantially parallel to the longitudinal axis of the vanes. These alternating magnetic fields, in turn, induce quadrant currents that alternately charge and discharge the vane tips. The alternating charge on the vane tips provides the means for accelerating a charged particle through the narrow region between the vane tips.

As seen best in FIG. 1B, the current loops *13a*, *13b*, *13c*, and *13d* protrude through respective slots *24a*, *24b*, *24c*, and *24d* in the vane housing 16. The loops are oriented transversely relative to the longitudinal axis of the RFQ linac so that the resulting magnetic field is substantially parallel to the longitudinal axis of the RFQ linac. The vanes themselves serve as boundaries for the magnetic fields, forcing the magnetic flux lines to longitudinally wrap around the vanes, passing through the cutouts 17 at the ends of each vane to an adjacent quadrant. The current loop slots *24a*, . . . , *24d* may be positioned at any convenient location along the length of the RFQ linac. Some embodiments of the CCRF power system place these slots approximately midway along the length of the linac; other embodiments place the slots towards one end of the linac.

Figure 2:
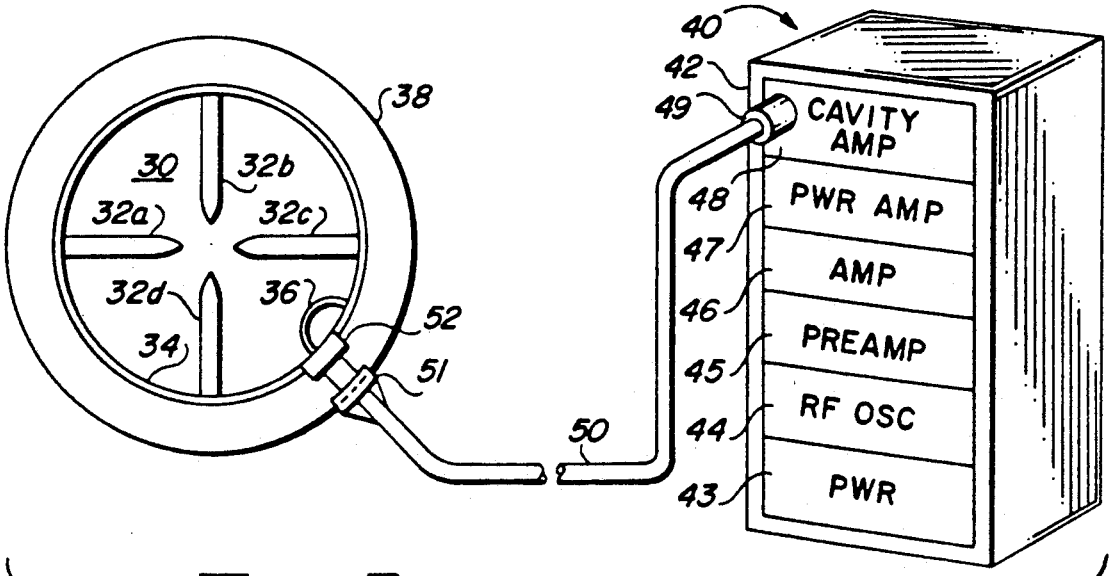
FIG. 2 (PRIOR ART)
FIG. 2 illustrates a prior art system for delivering high peak rf power to an RFQ linac.

Referring next to FIG. 2, a prior art system for delivering high peak rf power to an RFQ linac 30 is shown. The RFQ linac 30 is substantially the same as the RFQ linac 12 described above in FIGS. 1A and 1B, and includes four vanes *32a*, *32b*, *32c* and *32d* mounted to a vane housing 34. A current loop 36 protrudes into each quadrant of the linac 30. (Only one current loop 36 is shown in FIG. 2 for clarity, but it is understood that additional current loops may be utilized in the other quadrants of the linac.) The RFQ linac is housed within a suitable vacuum housing 38. High RF power is generated external to the vacuum housing 38 by an RF power system 40. The RF power system 40 typically fills an entire equipment rack 42, or more, with various components required to generate the high RF power. For example, the rack 42 typically must include a power supply 43 for generating the required operating power for the system. The rack also includes an rf oscillator 44 for generating an rf signal, as well as a preamplifier 45 for amplifying the rf signal from the rf oscillator to a low power level. An additional amplifier 46 is also typically used for amplifying the low level rf signal to an intermediate power level. Then, a power amplifier 47 amplifies the intermediate level rf signal to a high power level. This power amplifier 47 typically includes one or more resonant cavity amplifiers 48, which may (depending upon the particular rf frequency employed) be large, precision, expensive components. A coupling device 49 must then be used to couple the high rf power out of the resonant cavity amplifiers 48 to a suitable transmission line 50. The transmission line 50, due to the high power signals being transferred therethrough, may also be large and bulky, and may even need to be constructed from rigid waveguide.

After transferring the power from the rf power system 40 through the transmission line 50 to the vacuum housing 38, an rf window 51 must be employed in order to allow the rf power to enter the vacuum housing while preserving the integrity of the vacuum. While many different window devices are known in the art, they too represent an expensive, precision component of the rf power system of the prior art. Finally, a suitable collector device 52, or equivalent, must be used in order to collect the high rf power passed through the window 51 and convert it to an electrical current suitable for applying to the looped conductor 36. The looped conductor is then connected to rf ground through suitable high voltage isolation. Cooling systems are also employed in order to remove any heat at the load that is not transferred to the linac.

Advantageously, the present invention eliminates the need for having the high rf power components external or remote from the linac. Rather, the high rf power components used by the close-coupled rf power system herein described are positioned within the vacuum housing. Not only are these components positioned within the vacuum housing, but the linac structure itself forms an integral part of the rf power amplifier. This arrangement of components, wherein the linac cavity serves a dual purpose, allows the system to be greatly simplified over prior art systems. Hence, the cost of the system is reduced, and (with fewer critical components being used) the reliability of the system increases.

Figure 3:
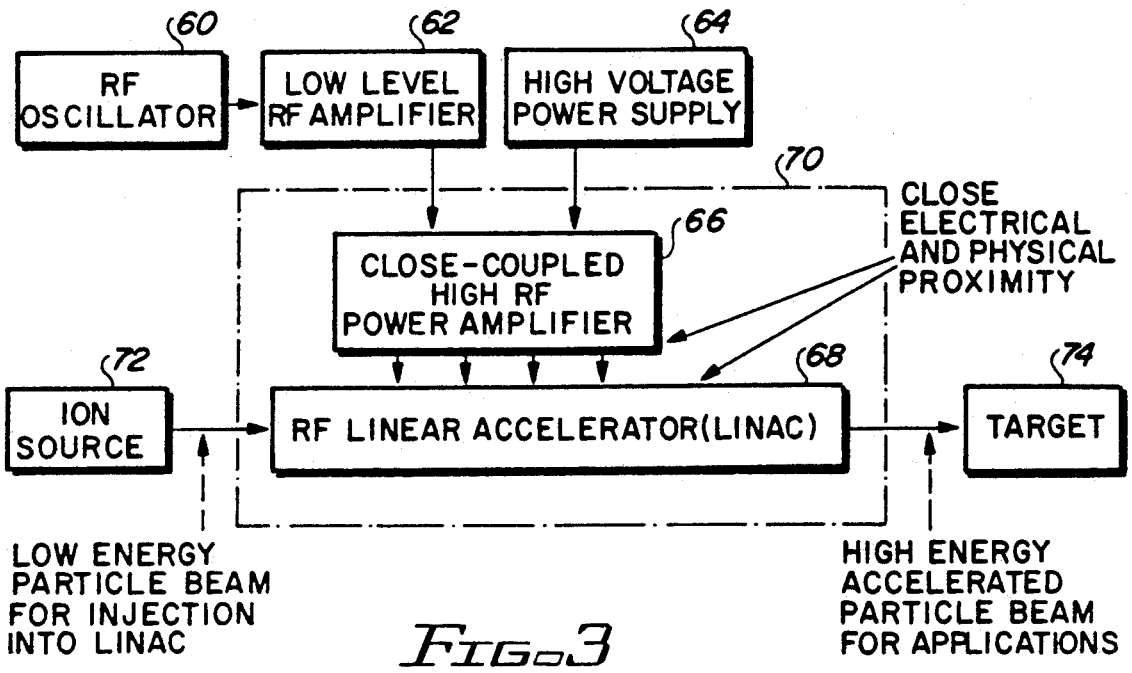
FIG. 3 is a block diagram of the close-coupled rf (CCRF) power system of the present invention.

A block diagram of the CCRF power system of the present invention is shown in FIG. 3. As seen in FIG. 3, the CCRF power system includes an rf oscillator 60 that generates an rf signal. This rf signal is amplified in a low level rf amplifier 62, e.g. to 2 kW. The output signal from the low level amplifier 62 is then transferred, using conventional rf transmission means, such as a standard RG-8 coax cable, to a close-coupled rf (CCRF) high power amplifier 66. The CCRF high power amplifier is in close electrical and physical proximity to an RF linac 68. Both the CCRF high power amplifier 66 and the RF linac 68 are housed within the same vacuum housing 70. A high voltage power supply 64, external to the vacuum housing 70, is also coupled to the CCRF high power amplifier 66. Advantageously, both the rf drive line, connecting the low level rf amplifier 62 with the CCRF high power amplifier, as well as the high voltage line, connecting the high voltage power supply 64 with the CCRF high power amplifier 66, may pass into the vacuum housing 70 using conventional electrical feedthrough means, without the necessity of a window device.

In operation, an ion source 72 provides a low energy particle beam that is injected into the linac 68. The linac 68, utilizing the power coupled from the CCRF high power amplifier 66 (which is in close electrical and physical proximity thereto), accelerates the particles in the particle beam up to a high energy level. The high energy particle beam is then directed to a suitable target 74, where it may be used for a desired medical, industrial, defense, scientific, or other application.

The CCRF power system of the present invention places the rf power sources close to the linac structure, and couples these rf power sources to the linac by a conductor (current loop) or aperture (iris) that is significantly shorter or smaller than a quarter of the free-space rf wavelength. Advantageously, the resonant properties of the linac structure are used to transform the lower impedance of the CCRF power amplifier to the higher impedance of the linac structure. By sharing the linac structure as the principle rf resonator of the entire system, as well as using it for its linear accelerator function, many considerations common to conventional linac system are dramatically simplified or eliminated.

Figure 4A:
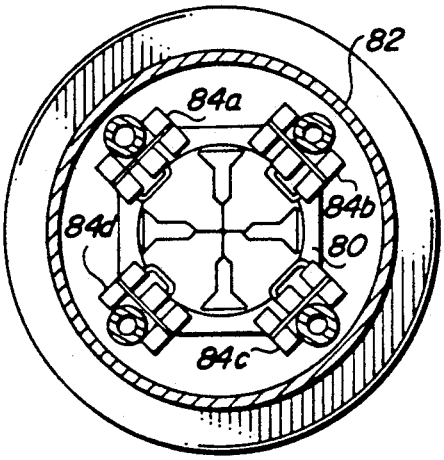
FIG. 4A is an end view of an RFQ linac housed within a vacuum cylinder showing four CCRF power amplifiers mounted to the sides of the RFQ linac.
Figure 4B:
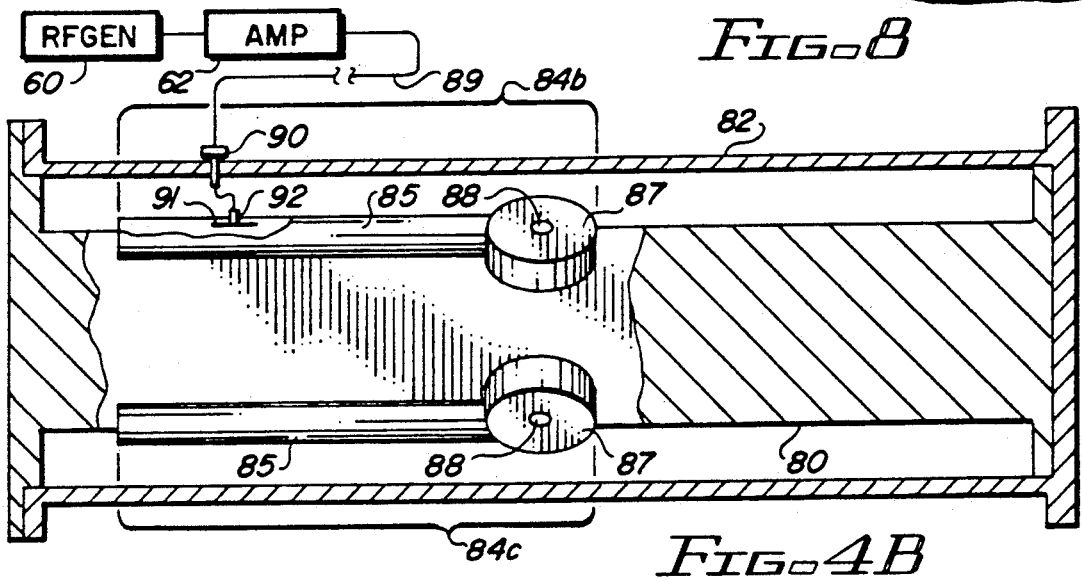
FIG. 4B shows a side view of the RFQ linac of FIG. 4A, with most of the vacuum cylinder being removed to better show the CCRF power amplifiers affixed to the side of the RFQ linac, with two of the four CCRF power amplifiers being visible, each employing a single triode tube.

FIG. 4A shows an end view of an embodiment of the invention utilizing an RFQ linac 80 mounted within a vacuum cylinder 82. FIG. 4B shows a side view of the RFQ linac 80 of FIG. 4A, with portions of the vacuum cylinder 82 being removed. CCRF power amplifiers 84*a*, 84*b*, 84*c* and 84*d* are affixed to the side of the RFQ linac 80, as seen best in the end view of FIG. 4A. Two of the four CCRF power amplifiers, 84*b* and 84*c*, are visible in FIG. 4B.

As seen in FIG. 4B, rf input power is coupled into the CCRF power amplifiers 84*a*, 84*b*, 84*c* and 84*d* from the external low level rf amplifier 62, driven by an rf generator (oscillator) 60, using a suitable length 89 of conventional coax cable, such as RG-8 cable. This connection is coupled through the wall of the vacuum housing 82 utilizing a conventional feedthrough connector 90, such as a Type N coax connector. As explained below in conjunction with FIGS. 9A and 9B, once inside of the vacuum housing 82, the connector 90 is connected to respective input connectors 92, which may also be conventional Type N connectors, associated with each CCRF power amplifier.

The preferred power source for use within the CCRF power amplifiers 84*a*, 84*b*, 84*c*, and 84*d* is a planar triode tube, such as the planar triode tubes Y-690, YU-141 141, or YU-176 manufactured by Varian/Eimac of Salt Lake City, Utah. Such tubes are small in size, simple in geometry, and low in cost. A single tube can produce 30 kW of peak rf power with a 1% rf duty factor and an efficiency of 60% over a wide range of frequencies up to 2 GHz. A cluster of 12 of such small tubes may be used to produce as much as 360 kW of peak rf power at 425 MHz for linac applications.

For an RFQ linac requiring 80 kW of peak rf power, one planar triode tube 88 may be used within each CCRF power amplifier 84*a*, 84*b*, 84*c*, and 84*d*, as shown in FIG. 4B. This arrangement thus places one planar triode in each quadrant of the RFQ linac, and represents a conservative and symmetrical configuration having ample power for normal operation, with sufficient reserve to survive the failure of any single triode.

Figure 4C:
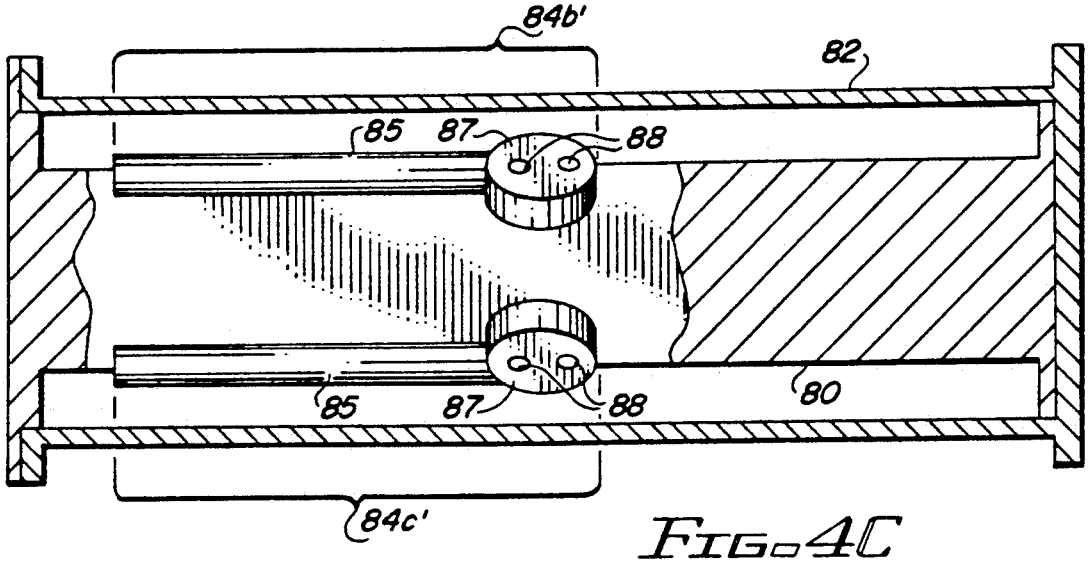
FIG. 4C is a side view of an RFQ linac as in FIG. 4B, with two of four CCRF power amplifiers being visible, each employing two triode tubes.

For an RFQ linac requiring 200 kW of peak rf power, a pair of planar triodes 88 in each of four CCRF power amplifiers 84*a*', 84*b*', 84*c*' and 84*d*', may be used. Such a configuration is illustrated in FIG. 4C. This configuration advantageously provides ample power for normal operation, with sufficient reserve to survive the failure of several triodes. Advantageously, each pair of triodes may be clustered together as a unit with their outputs combined into a single rf drive loop, as explained more fully below.

Figure 5A:
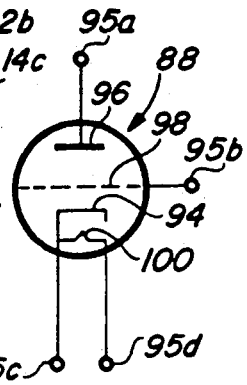
FIG. 5A shows a schematic diagram of a triode tube.

FIG. 5A shows a schematic diagram of a triode tube 88. The triode includes a cathode 94, an anode 96, a grid 98, and a heater element 100. There are four terminals through which electrical contact is made with the triode 88: an anode terminal 95*a*, a grid terminal 95*b*, a cathode terminal 95*c*, and a heater terminal 95*d*. The heater element shares another terminal with the cathode. Hence, a heater current is applied through terminals 95*c* and 95*d*.

Figure 5B:
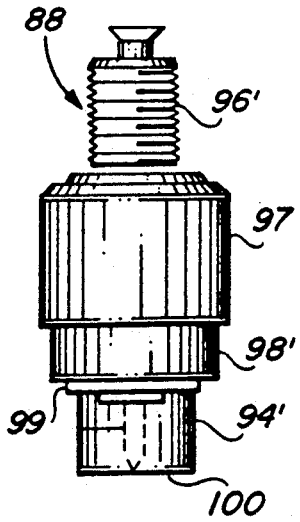
FIG. 5B shows a mechanical side view of a triode tube of the type used with the CCRF power amplifier of the present invention.

FIG. 5B shows a mechanical side view of a triode tube of the type used with the CCRF power amplifier of the present invention. An anode tip 96' is at one end of the triode. This anode tip is threaded to facilitate its insertion into a threaded anode block, and electrical connection can be made with the anode 96 at any point on the anode tip 96'. Thus, the anode tip 96' is electrically equivalent to the anode terminal 95*a* shown in FIG. 5A. An electrical insulator 97 forms a central portion of the triode body. A grid ring 98' surrounds the triode 88 on the side of the insulator 97 opposite the anode cap 96'. Electrical contact may be made with the grid at any location around the grid ring 98'. Hence, the grid ring 98' is electrically equivalent to the grid terminal 95*b* shown in FIG. 5A. A cathode cylinder 94' is found below the grid ring 98'. The cathode cylinder 94' has a diameter smaller than the grid ring 98'. An insulating sleeve 99, placed over the cathode cylinder 94' prevents the cathode 94 from making direct electrical contact with the grid 98. The heater element 100 is placed inside of the cathode cylinder 94'. Electrical contact may be made with the cathode 94 at any point on the surface of the cathode cylinder 94'. Thus, the cathode cylinder 94' represents the equivalent of the cathode terminal 95*c* shown in FIG. 5A.

The theory of operation of a triode tube, and the manner of using triode tubes, are well known in the art.

In accordance with a key feature of the present invention, the planar triode is operated in a "grounded grid" configuration. In a grounded grid configuration, the anode 96 and a current loop (connected to the anode) operate at an elevated potential (e.g., 6–8 kV). This elevated potential is provided by the high voltage power supply 64 (FIG. 3). As explained more fully below, the compact geometry of the triode 88 further provides, in combination with the other elements of the CCRF power amplifier, a configuration exhibiting a considerable capacitance to ground (zero potential) through which high rf currents may pass.

As can be seen in FIGS. 4A–4C, the CCRF power amplifiers 84*a*, . . . , 84*d*, each include an input resonator tube 85 and an amplifier assembly 87. The input resonator tube 85 receives the rf input drive signal, over the signal line 89 from the low level rf amplifier 62 (FIG. 4B). The resonator tube 85 is designed to resonate at the frequency of the rf input drive signal, thereby providing matching and tuning of the signal. The resonator tube 85 may take numerous forms. A preferred form would be a quarter wavelength coaxial cavity because it has less loss and sharper resonance. However, at 425 MHz, a three-quarter wavelength cavity is more practical.

The coaxial cavity has the outer conductor grounded, and a sliding short at one end. This sliding short may also take numerous forms. In FIG. 4B, it is shown as a slot 91 in which the connector 92 is slidably mounted. The amplifier assembly 87 is secured to one end of the resonator tube 85. The triode tube(s) 88 is (are) mounted in a central location within the resonator tube 85, positioned so as to have an open end of the resonator tube connected to the cathode of the triode 88.

Figure 6:
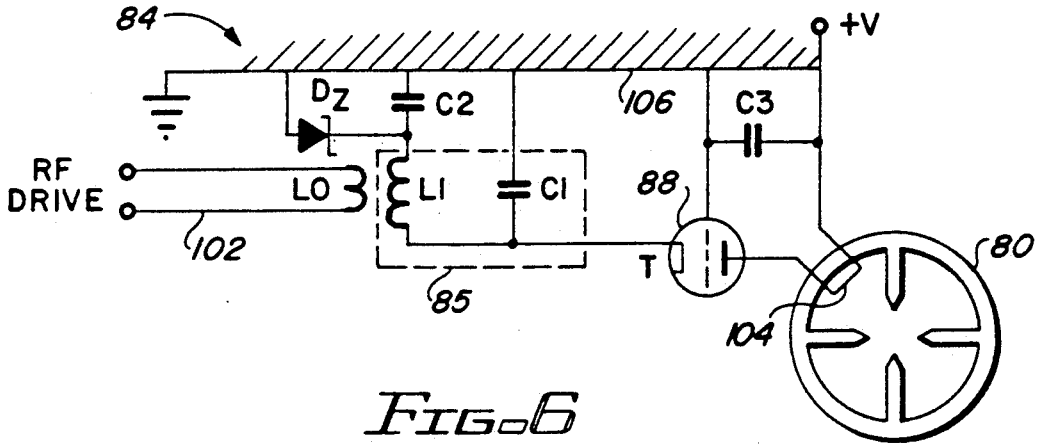
FIG. 6 is an electrical schematic diagram of a single triode tube CCRF power amplifier made in accordance with the present invention.

FIG. 6 shows an electrical schematic diagram of a single triode tube CCRF power amplifier 84 made in accordance with the present invention. If more than one triode tube 88 is used, such additional tube(s) is (are) connected in parallel with the tube 88. For simplicity, the heater element 100 of the triode 88 is not shown in FIG. 6. The resonator tube 85 is represented in FIG. 6 by an L-C resonant circuit comprised of inductor L1 and capacitor C1. Power is coupled into the resonator tube 85 by way of the rf input drive signal in conventional manner. This coupling is represented in FIG. 6 by an inductive coupling between an inductor LØ at the end of an rf input drive line 102 and the inductor L1. (It is emphasized that the components LØ, L1 and C1 may not physically exist within the power amplifier 84. Rather, these components are used to represent an equivalent of the components actually present.)

Still referring to FIG. 6, it is seen that the anode of the triode 88 is connected to a current loop 104 that protrudes into a quadrant of an RFQ linac 80. After looping through a desired portion of the linac 80, connection is made with a high voltage, +V (obtained from the high voltage power supply 64 (FIG. 3)), and with a capacitor C3. This high voltage may be on the order of 8–12 kilovolts (kV). The other side of the capacitor C3 is grounded, as is the grid of the triode 88. This grounding is represented in FIG. 6 by a ground strip 106. A zener diode $D_z$ is connected between the ground strip 106 and the cathode of the triode 88 so as to provide a desired bias voltage on the cathode. This bias voltage, for the triodes described herein, is on the order of 40 volts. As shown in FIG. 6, this bias voltage is positive relative to ground, i.e., the cathode of the zener diode $D_z$ is grounded, and the anode of the zener diode is connected to the cathode of the triode 88. Another capacitor C2 is connected between the L-C resonant circuit (resonator tube) 85 and ground.

In operation, the capacitor C2 serves the function of a blocking capacitor and prevents dc currents from flowing to ground. The zener diode, $D_z$, or equivalent, is connected between the junction of L1 and C2 and ground. This zener diode places a bias voltage on the cathode of the triode about which a cathode input signal, derived from the resonator tube 85, operates. The triode tube amplifies this signal, and provides a high current rf output signal at its anode that has the same frequency as the cathode input signal. This high current rf signal generates a magnetic field within the linac as previously described. After generating such magnetic field, the high current rf signal is shunted to ground through the capacitor C3. Thus, the capacitor C3 serves the function of an rf bypass capacitor.

Figure 7:
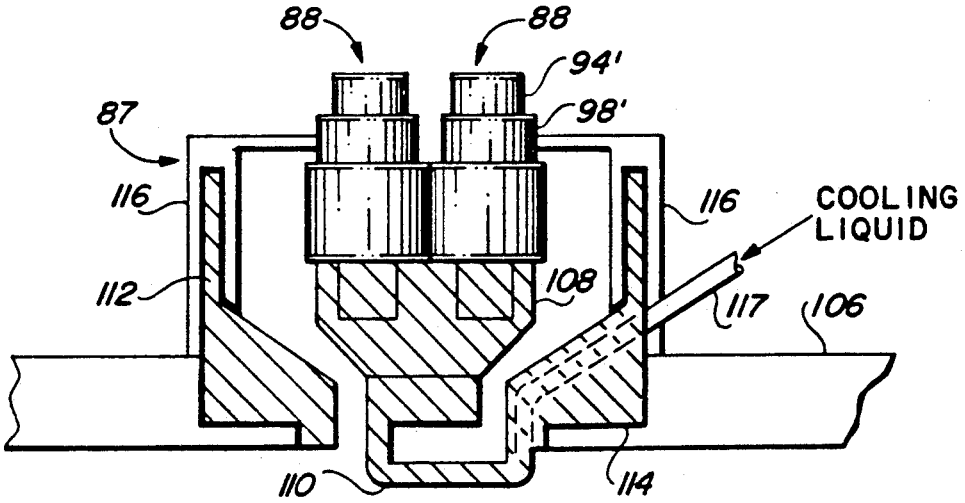
FIG. 7 illustrates a side schematic view of a two or four triode tube CCRF power amplifier mounted on the wall of a linac or other charged particle structure in accordance with one embodiment of the present invention.

Referring next to FIG. 7, there is shown one embodiment of the amplifier assembly 87 mounted to a wall 106 of a linac. FIG. 7 is a side schematic view of an amplifier assembly 87 that utilizes two or four triode tubes 88. The anode tips of the triodes 88 are screwed into an anode cap 108. At least one rigid conductor 110 connects the anode cap 108 to an anode ring 112. An insulating material 114 (shown in FIG. 7 as a heavy line) prevents direct electrical contact between the anode ring 112 and the wall 106. A grid plate 116 electrically connects the grid ring 98' of the triodes 88 to the wall 106. The wall 106 is grounded. The anode cap 108, the conductor 110, and the anode ring 112 are all maintained at a high anode voltage. These components (at the high anode voltage) are shown in FIG. 7 in cross-hatch.

Advantageously, the insulating material 114 serves as a dielectric between the anode ring and the grid plate/-wall 116/106. These components thus function as the bypass capacitor C3 (FIG. 6).

Preferably, the conductor loop 110 is made from copper tubing 117, or other suitable conductive tubing, through which a cooling fluid, such as de-ionized water, may be pumped in order to remove heat from the anode cap 108. After exiting the vacuum housing, a suitable non-conductive tubing, such as plastic tubing, is joined to the conductive tubing in order to prevent anode currents from flowing to the pump source. Advantageously, the copper tubing that exits the vacuum housing provides a convenient conductor for connecting the high voltage power supply to the anode cap.

Figure 8:
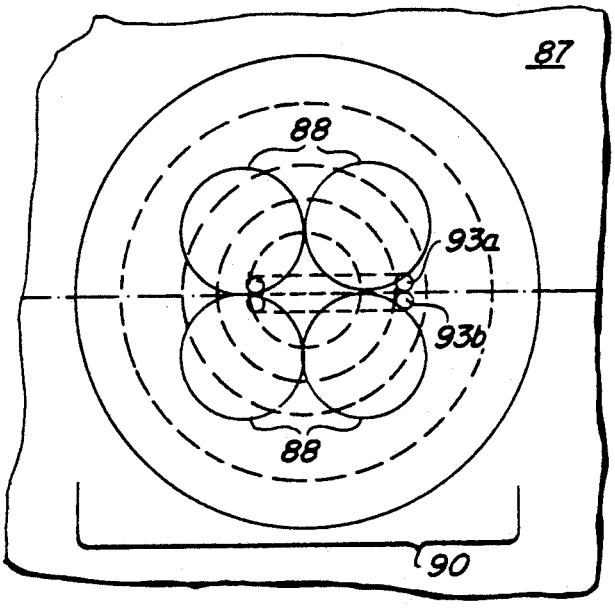
FIG. 8 depicts the layout of a four-triode tube CCRF power amplifier.

FIG. 8 depicts the layout of a four-triode tube CCRF power amplifier. In FIG. 8, four triodes 88 are used within a single amplifier assembly 87. This configuration provides the ability to increase the output power capability of the amplifier, and further improves the reliability of the amplifier. For example, if other types of linacs are used, such as DTL linacs, many megawatts of power may be needed. Such power may be provided by clusters 90 of four planar triodes 88, connected to rf drive loops **93*a* and 93*b*, as shown in FIG. 8. Advantageously, the clusters 90 need only be about 4 inches in diameter. Ten such clusters could produce 1 MW of power. One cluster every 4 inches represents a linear power density of 1 MW/m. Should one or more of the triodes in the cluster 90** fail, the remaining triodes are still able to provide sufficient power for the linac (or other charged particle system) to function.

It is also noted that an array of small planar triodes could be used, e.g., to power a CCL linac, even at frequencies that are typically higher than those frequencies used in RFQ and DTL linacs.

Figure 9A:
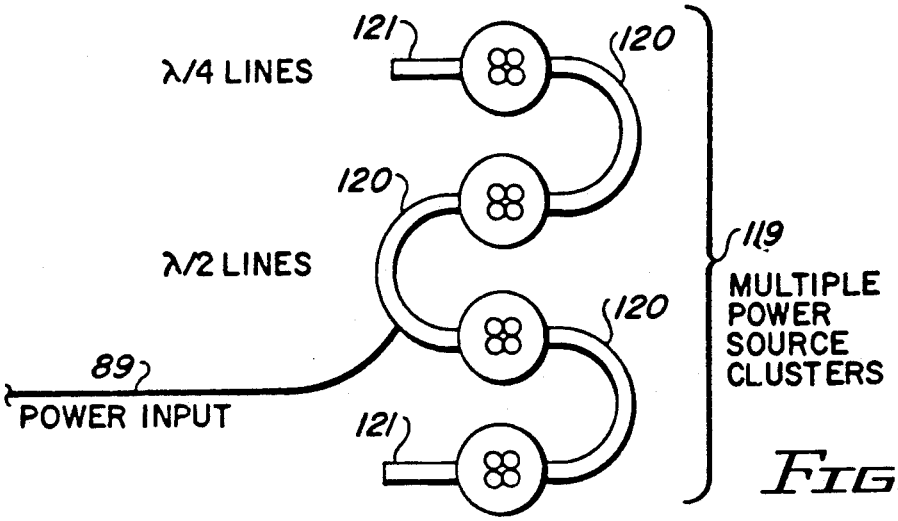
FIG. 9A schematically illustrates one technique that may be used to direct input power to the four CCRF power amplifiers used with an RFQ linac.

FIG. 9A schematically illustrates one embodiment of the invention used to direct input power to the four CCRF power amplifiers used with an RFQ linac. Many different types of input resonating cavities 85 may be used with the present invention. Care must be taken to ensure that such cavities are driven in the proper phase so that their respective output power combines constructively. The configuration shown in FIG. 9A represents a resonantly coupled chain 119 that drives adjacent amplifiers in the chain in an opposite phase. In such chain, the input rf drive line 89 is connected to three half-wavelength lines 120 connected between the amplifier assemblies 87 of the chain. These half-wavelength lines 120 function as the input resonator 85 for each power amplifier 84. A quarter wavelength stub 121 is attached to each of the end amplifier assemblies 87 of the chain.

Figure 9B:
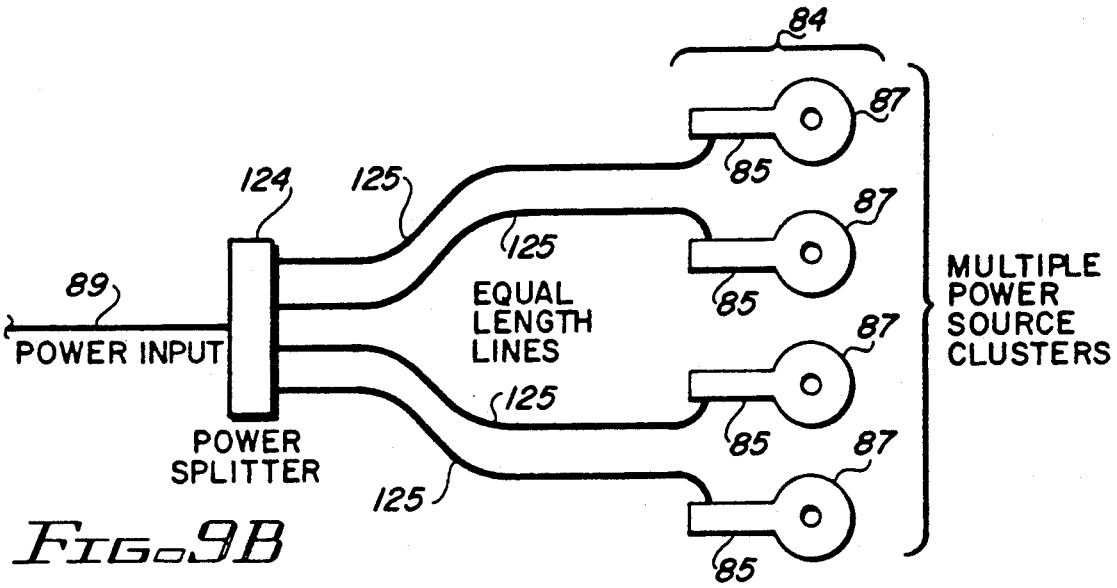
FIG. 9B schematically illustrates an alternative technique that may be used to direct input power to the four CCRF power amplifiers of an RFQ linac.

The configuration shown in FIG. 9B represents an alternative embodiment for directing input power to the power amplifiers 84. As seen in FIG. 9B, the input rf drive line 89 is connected to a power splitter 124. Four equal length lines 125 are then used to couple the power to each of the resonant cavities 85 of the power amplifiers 84. Each of the amplifiers in FIG. 9B is driven in phase with the other amplifiers.

It is also noted that the power amplifiers could be driven as a plurality of coupled strip lines, s described in U.S. Pat. No. 4,707,668.

Figure 10:
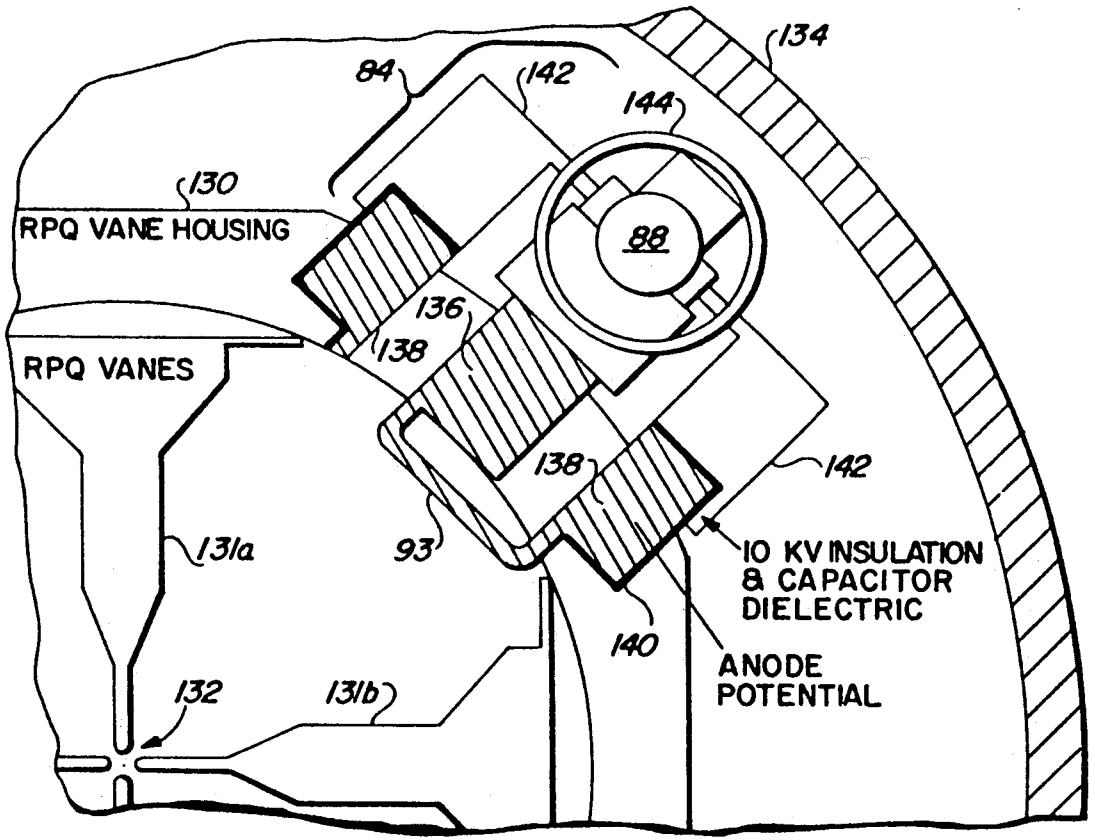
FIG. 10 shows a schematic view of another embodiment of the CCRF power amplifier of the invention mounted to an RFQ linac.

Referring next to FIG. 10, there is shown a sectional view of another embodiment of the CCRF power amplifier 84 of the invention as mounted to an RFQ linac. The RFQ linac includes a vane housing 130 to which four vanes are mounted as previously described. (Two vanes 131*a* and 131*b* are visible in FIG. 10, with the tips of all four vanes being visible at 132.) The RFQ linac is housed within a vacuum housing 134. The CCRF power amplifier 84 is mounted to the vane housing 130 so that at least one current loop 93 protrudes into a quadrant of the RFQ linac. As with the embodiment shown in FIG. 7 above, the current loop 93 is attached to an anode cap 136 and an anode ring 138. The anode ring 138, anode cap 136, and current loop 93 are all maintained at the anode potential, and are all shown in cross-hatch. An insulator and capacitor dielectric 140, represented as a dark wide line in FIG. 10, prevents direct electrical contact between the anode ring and a grid ground connector 142. An input coaxial cavity 144 receives the input rf drive signal and directs it to a triode 88 located at one end thereof. The grid of the triode 88 is connected to ground through the grid ground connector 142.

Figure 11B:
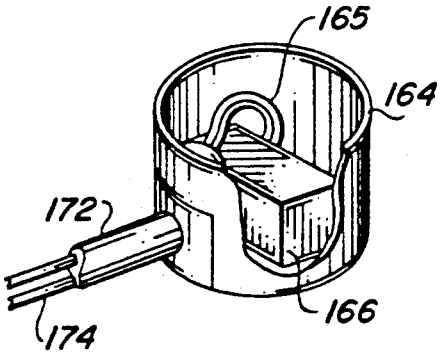
FIG. 11B shows a cutaway view of the anode ring of FIG. 11A, this view being from a different angle than is shown in FIG. 11A, the view of FIG. 11B showing the current loops that protrude from the bottom of the anode ring, and the anode cap located inside of the anode ring to which the current loops are attached.
Figure 11A:
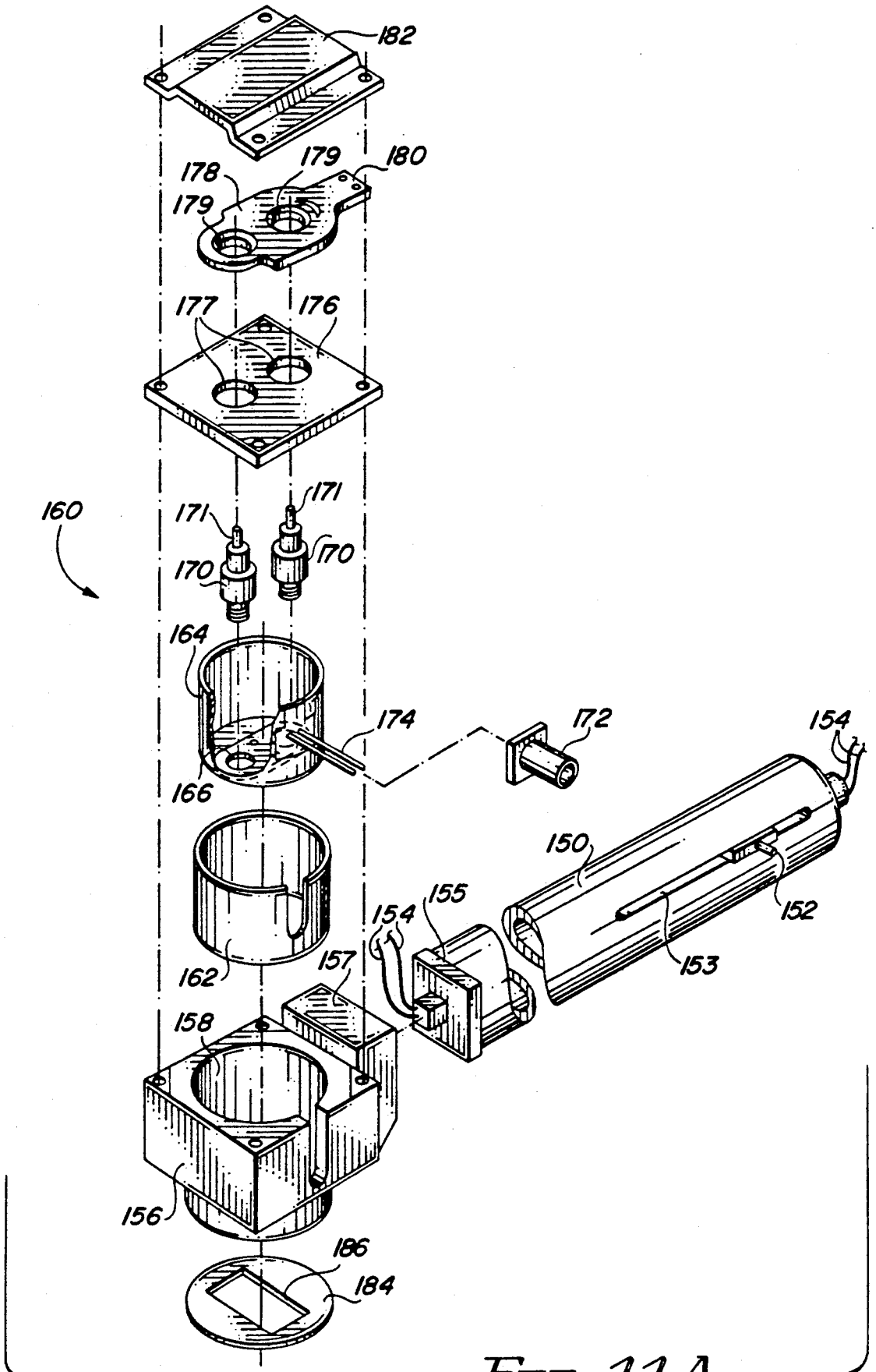
FIG. 11A is an exploded assembly view of a CCRF power amplifier made in accordance with a preferred embodiment of the present invention.

FIG. 11A shows an exploded assembly view of a CCRF power amplifier made in accordance with a preferred embodiment of the present invention. The embodiment includes an input resonator 150 having an input power connector 152 along one side thereof. The input power connector is mounted for slidable movement within a slot 153. Electrical wires 154 pass through the resonator 150 in order to provide electrical connection to the cathode and heater elements of the two triode tubes. A zener diode (not shown in FIG. 11A) is connected between one of the wires 154 and ground at a suitable location external to the resonator tube 150. A flange 155 facilitates attachment of the resonator tube 150 to a matching flange 157 of a body block 156.

The body block 156 houses an amplifier assembly 160. The body block 156 has a bore 158 therethrough. A teflon cup 162 slides over an anode ring 164. The anode ring 164 includes an anode cap 166 in the center thereof. The anode cap has two threaded holes 168 therein adapted to receive the anode of respective triode tubes 170. The anode cap 166 is held in the center of the anode ring 164 by means of two rigid tubes 165, e.g., copper tubes, that form a loop as they pass between the anode cap and anode ring, as seen best in FIG. 11B. FIG. 11B shows a cutaway view of the anode ring 164 from a different angle than s shown in FIG. 11A. An extension 174 of these tubes 165 protrudes out a side of the anode ring 164. A teflon bushing 172 fits over the tube extension 174. The high voltage from the high voltage power supply 64 is advantageously coupled into the anode cap 166 and anode ring 164 via the extension of the rigid tubes 174.

A grid plate 176 is configured to securely attach to the body block 156. This grid plate includes two apertures 177 therein sized to tightly fit around the grid ring of the respective triodes 170, thereby making firm and secure electrical contact therewith. Similarly, a cathode plate 178 includes two apertures 179 therein adapted to tightly fit around (and hence make firm and secure electrical contact with) the cathode cylinders of the triodes 170. A flange 180 protrudes out from one side of the cathode plate 168 and is adapted to mount within the body block flange 157. A cover plate 182 attaches to the body block 156 and closes in the triode assembly 160. A bottom plate 184 defines a slot 186 through which the conductive tubing 165 protrudes when the assembly 160 is mounted to the wall of a linac.

Figure 12:
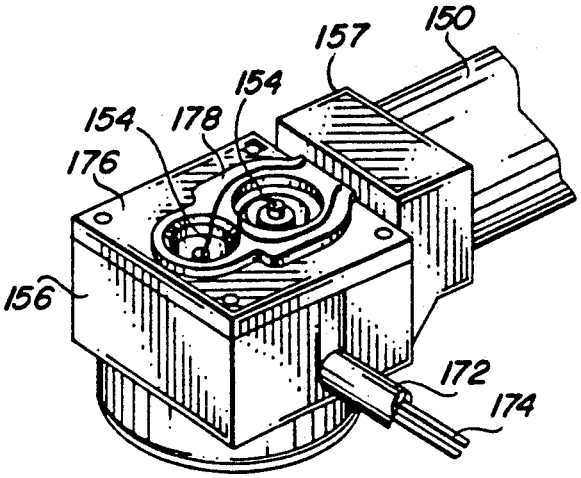
FIG. 12 shows an assembled view of the CCRF power amplifier of FIG. 11A minus the cover box.

FIG. 12 shows an assembled view of the CCRF power amplifier of FIG. 11A and 11B, with only the cover plate 182 removed. As seen in FIG. 12, the heater wires 154 pass along the cathode plate 180 and are attached to the heater element terminal 171 located in the center of the triode tubes 170. The cathode plate 178 is held in a spaced apart position relative to the grid plate 176 by the position of the mounting flange 180 within the body block flange 157. Before placing the cover plate 182 over the assembly, suitable rf shields, e.g., made from thin copper plate, may be placed over the cathode plate 178, and around the edges of the grid plate, or at other locations, in order to prevent rf leakage.

Figure 13A:
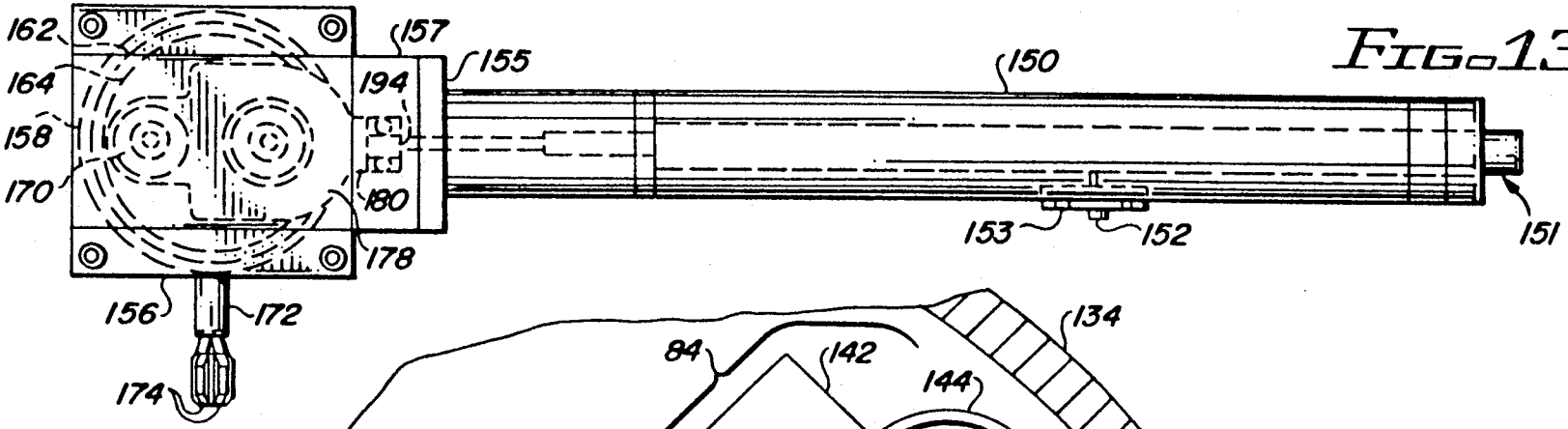
FIG. 13A shows a top view of the assembled CCRF power amplifier of FIG. 11A.

FIG. 13A shows a top "x-ray" view of the assembled CCRF power amplifier of FIG. 11A, where "top" is defined as radially looking towards the center of the linac to which the CCRF power amplifier is attached, and "x-ray" refers to the fact that the profiles of various elements and components within the assembly can be discerned. The same reference numerals are used in FIG. 13A as are used in FIG. 11A.

Figure 13B:
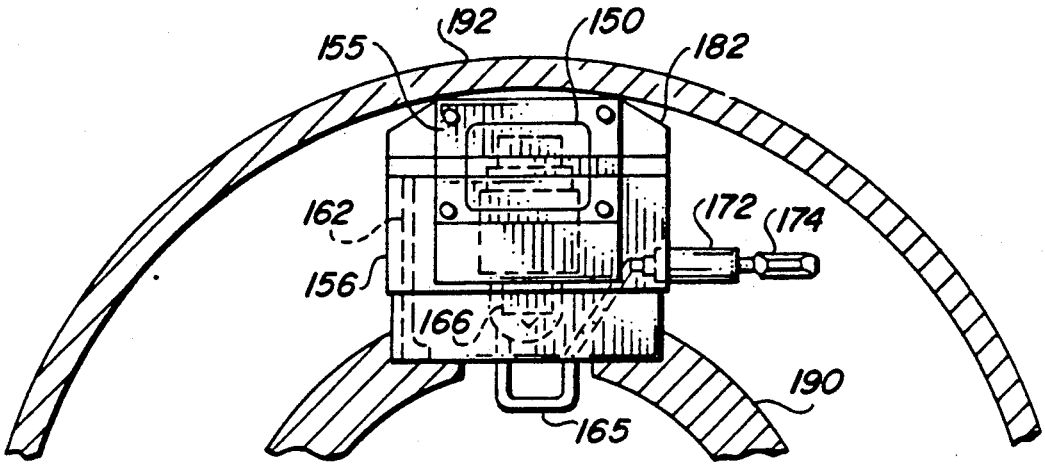
FIG. 13B shows a end view of the assembled CCRF power amplifier of FIG. 13A mounted to a side wall of a linac.

Similarly, FIG. 13B shows an end "x-ray" view of the assembled CCRF power amplifier of FIG. 13A mounted to a side wall 190 of a linac. The linac is housed within a vacuum housing 192. The same reference numerals are used in FIG. 13B as were used for FIG. 11A for the other elements shown.

Figure 13C:
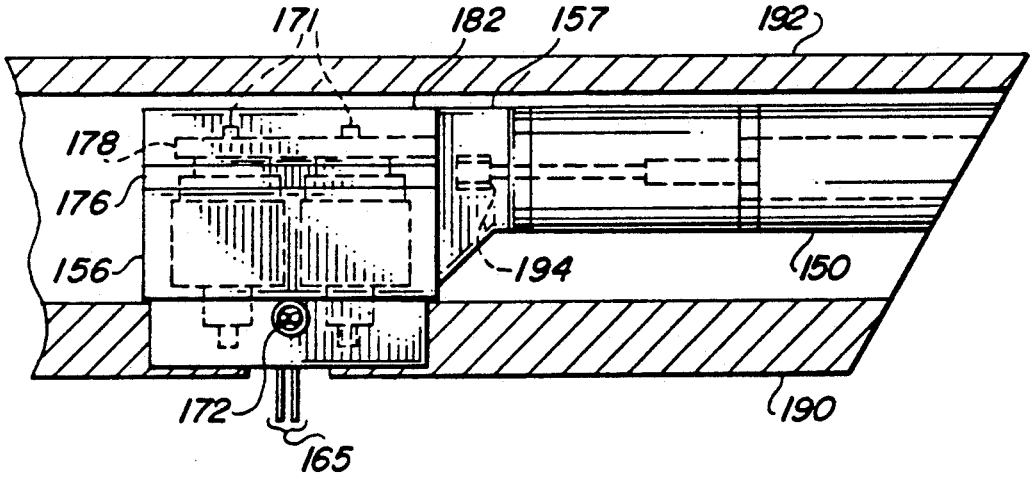
FIG. 13C shows a side view of the assembled CCRF power amplifier of FIG. 13B.

Likewise, FIG. 13C shows a side "x-ray" view of the assembled CCRF power amplifier of FIG. 13B. Note from both FIGS. 13B and 13C how the CCRF power amplifier fits efficiently within the vacuum space defined by the vacuum housing 192. Also, as seen best in FIG. 13C, note that two tubal conductors 165 are used through which the anode current flows. This facilitates pumping of a cooling fluid to and from the anode cap. Also, as best seen in FIG. 13C, there is a detachable mechanical and electrical connection, or "joint" 194, between the resonator 150 and the cathode plate flange 180. This joint 194 makes the cathode plate 178 and the cathode end of the triodes 170 part of the input resonator 150. The input resonator 150, including the joint 194 and the cathode plate 178 advantageously perform the function of an impedance transformer. That is, these elements match the impedance of the input drive line 89, e.g., a 50 ohm impedance, to the low impedance of the triodes 170.

In operation, the above-described CCRF power system, comprising a plurality (e.g., four) CCRf power amplifiers affixed the linac structure within the vacuum housing provides a very tidy, reliable and economical accelerator package. Peak rf powers in the range of 15-25 KW from a single triode tube have been achieved. A cluster of two such triode tubes within each CCRF power amplifier thus provides up to 200 KW of peak power, assuming a power system that includes four such CCR power amplifiers. Higher power levels, of course, are possible by increasing the number of triodes in the triode cluster within each CCRF power amplifier.

Further, based on prototypes of the CCRF power amplifier that have been built and tested to date, there are no troublesome electron phenomenon associated with operation of the input resonator in a vacuum (e.g., multipactor glow-discharge). Moreover, there have been no troublesome electron phenomenon associated with operation of the high voltage parts of the triode in the vacuum; nor have there been any troublesome thermal phenomenon associated with operation of the CCRF power amplifiers in the vacuum.

Surprisingly, it has also been discovered through tests conducted that only a small current loop (e.g., 165 in FIG. 11B) is required to make a proper match to RFQ structures. For example, a loop that protrudes approximately 0.25 inch into a 6 inch diameter RFQ linac, provides sufficient coupling to trigger the desired operation of the RFQ linac.

For optimum performance, the CCRF systems must be properly tuned and matched to the resonant load to which it is attached. The data available for these operations include the forward and reflected power on the rf drive line, the cathode plate excitation, the cathode bias (provided by the zener diode $D_z$), the anode voltage and current, and the output power as determined by a calibrated monitor loop in the output resonator. (The output resonator is the RFQ linac structure.) The variables effecting these data are the positions of the input resonator sliding short (the input resonator sliding short is located at a closed end 151 of the input resonator), the position of the input resonator drive tap (the input resonator drive tap is the position of the connector 152 within the longitudinal slot 152), the cathode bias (by selection of the zener diode), and the size, shape and orientation of the coupling loop that couples the anode current to the magnetic field of the resonant load. The procedures for adjusting these variables to realize the optimum performance include:

1. Adjusting the rf drive frequency to the resonant frequency of the resonant load;

2. adjusting the positions of the input resonator tuning stub and input resonator drive tap to achieve a minimum reflected power on the rf drive line while maintaining a significant cathode plate excitation; and 3. adjusting the size, shape and/or orientation of the coupling loop to achieve high efficiency ($\geqq 70\%$) power transfer to the resonant load and high power gain ($\geqq 13$ db) across the planar triode amplifiers as indicated by the calibrated monitor loop signal.

Operating frequencies of the CCRF power amplifier herein described may range from 50 to 2000 MHz. At the higher frequencies, care must be exercised to keep the physical dimensions of the coupling loop small compared to the rf wavelength.

It should be appreciated that the CCRF power system described above offers many advantages over conventional rf power systems. For example, the close-coupled, loop driven scheme: (1) eliminates the need for separate rf output cavities for each power source; (2) eliminates the need for transmission lines between each power source and the linac; (3) eliminates the need for high-power rf windows for each transmission line; (4) replaces the conventional rf drive loop with an integrated drive loop for each power source or cluster of power sources; and (5) provides a convenient, rigid, mechanical support for each power source (i.e., triode tube).

There are two distinct advantages to powering linacs with a multiplicity of smaller power units, as disclosed herein, instead of with a single large power unit, as is commonly done in the prior art. First, it is relatively easy to survive the failure of any one power unit by calling upon some reserve power from the remaining units. Second, the system hardware, being small in size and large in number, provides a very favorable design and fabrication cost.

Further, there are substantial savings associated with rf close-coupled power sources in terms of cost, complexity, weight and efficiency for linac applications. For example, by integrating the rf power sources with the linac, many of the uncertainties of both entities are removed. Advantageously, all problems associated with the extraction of the rf power from the power source, transmission of the rf power to the linac, and the injection of the rf power into the linac, are solved, in the simplest way, by the present invention, i.e., they are no longer problems because there is no rf power to extract, no transmission of high rf power to the linac, and no injection of high rf power into the linac. Further, the system control is simplified by eliminating any concern over reflected power and standing waves in the non-existent transmission lines. Moreover, the rf power sources are no longer a constraint on the linac operating frequency since the major resonant element of the rf system is the linac itself. Still further, power efficiency is improved by eliminating the power dissipated in conventional rf power output resonators and transmission lines. System reliability is improved by using a multiplicity of small power units that provide a margin for failure for some units (triodes) without shutting the system down.

As described above, it is thus seen that the present invention provides a very compact source of rf power for accelerator applications that may operate at high frequencies. More particularly, as seen from the above description, the rf power source of the invention utilizes few parts, is light-weight, is economical to manufacture, and simple to operate. Further, it operates in the reliable, grounded-grid configuration.

As further evident from the above description, an efficient rf power system is provided that is easy and economical to manufacture, utilizing an rf power amplifier wherein the accelerator cavity also doubles as the rf output cavity. Hence, there is no need for a custom rf cavity at the design frequency, as is required with equivalent prior art rf power systems. Advantageously, the rf fields present in this dual rf output and accelerator cavity make only minor, and mostly insignificant, perturbations in the accelerator cavity fields. Moreover, the majority of the components utilized in the amplifier are advantageously designed independent of the operating frequency, with only an input cavity, detachably mounted to the accelerator cavity, being tailored to the design frequency.

Finally, as seen from the description of the invention presented herein, an rf power system for use with a linac is provided that requires only a standard flexible coaxial cable, e.g., an RG-8 cable, to deliver the rf input power to the system. Further, a standard coaxial connector, e.g., a Type N connector, is used as a vacuum feedthrough to couple power into the system. Hence, the invention eliminates the need for expensive, cumbersome waveguides and vacuum windows, as are commonly required in the prior art in order to couple high rf power to an accelerator.

While the invention herein disclosed has been described by means of specific embodiments and applications thereof, numerous modifications and variations could be made thereto by those skilled in the art without departing from the scope of the invention set forth in the claims.

What is claimed is:

1. A system for providing rf power to a linear accelerator, said linear accelerator being positioned within a vacuum housing, said system comprising:

rf generator means external to said vacuum housing for generating an rf signal at a first power level, said first power level being less than 2 kilowatts;

means for coupling said rf signal at said first power level to a location inside of said vacuum housing; and power amplifier means internal to said vacuum housing for receiving said rf signal at said first power level, amplifying it to a second power level to make an amplified rf signal, and delivering said amplified rf signal at said second power level to said linear accelerator, said power amplifier means being in close electrical and physical proximity to said linear accelerator.

2. The rf power system as set forth in claim 1 wherein said linear accelerator comprises a radio frequency quadrupole (RFQ) linear accelerator, or an RFQ linac, said RFQ linac including four vanes equally spaced around the inside circumference of a vane housing, said power amplifier means including four rf power amplifiers mounted to and spaced around the outside circumference of said vane housing, said vane housing including four apertures therein, a respective aperture for each rf power amplifier.

3. The rf power system as set forth in claim 2 wherein each of said rf power amplifiers include:

an input resonator having means for receiving said rf signal at said first power level and for delivering an output rf signal; and an amplifier assembly coupled to receive said output rf signal from said input resonator, said amplifier assembly including a body block, means for securing said body block to said vane housing at the location of said respective aperture, means housed within said body block for generating an electrical current in response to said output rf signal, and means for directing said electrical current into said RFQ linac through said respective aperture, said electrical current generating a magnetic field within said RFQ linac;

the magnetic fields induced by the electrical current generated by each of said rf power amplifiers combining to provide the operating power of said RFQ linac.

4. The rf power system as set forth in claim 3 wherein said means for generating an electrical current comprises at least one triode tube having a cathode in signal contact with said output rf signal from said input resonator, and an anode in electrical contact with a high voltage power source.

5. The rf power system as set forth in claim 4 wherein said at least one triode tube further includes a grid terminal electrically connected to a first reference potential.

6. The rf power system as set forth in claim 5 wherein said first reference potential to which said grid terminal is connected comprises ground potential.

7. The rf power system as set forth in claim 5 wherein said means for generating an electrical current further includes biasing means for biasing the cathode of said at least one triode tube at a second reference potential.

8. The rf power system as set forth in claim 7 wherein said biasing means comprises a zener diode electrically connected between said cathode of said at least one triode tube and said first reference potential.

9. The rf power system as set forth in claim 8 wherein said anode of said at least one triode tube is electrically connected to an anode block, and said anode block is electrically connected to an anode ring surrounding said anode block by means of at least one conductive member, said conductive member being formed in a loop that enters said RFQ linac through said respective aperture when said body block is secured to said vacuum housing.

10. The rf power system as set forth in claim 9 further including electrical insulation means for preventing direct electrical contact between said anode ring and said body block, said body block being maintained at said first reference potential.

11. The rf power system as set forth in claim 10 wherein said body block includes a bore therein, and said electrical insulation means comprises a dielectric cup adapted to fit around said anode ring, said anode ring and dielectric cup having a size that permits the anode ring and dielectric cup to fit snugly within said bore of said body block, said anode ring, dielectric cup, and bore functioning as a capacitor, said capacitor providing an electrical path through which said electrical current returns to said first reference potential.

12. The rf power system as set forth in claim 11 further including cooling means for removing heat from said anode and anode cap of said at least one triode tube.

13. The rf power system as set forth in claim 12 wherein said conductive member comprises a conductive tube, and wherein said cooling means includes means for pumping a suitable fluid through said tube.

14. The rf power system as set forth in claim 9 wherein said means for generating an electrical current comprises a pair of triode tubes mounted to said anode cap.

15. The rf power system as set forth in claim 9 wherein said means for generating an electrical current comprises four triode tubes mounted to said anode cap.

16. An rf power amplifier for use with a linear accelerator, said power amplifier comprising:

a resonating cavity comprising a resonating tube, said resonating tube having means near a first end thereof for receiving an input rf signal at a first power level; and an amplifier assembly attached to a second end of said resonating tube and closely-coupled to said linear accelerator for coupling power into said linear accelerator.

17. The rf power amplifier as set forth in claim 16 wherein said amplifier assembly comprises:

a body block having a bore therethrough, means housed within said body block for generating a high power electrical current in synchrony with said input rf signal, and conductor means for providing a signal and return path for said high power electrical current into and out of said linear accelerator, said high power electrical current generating a magnetic field within said linear accelerator, said magnetic field providing at least in part the operating power for said linear accelerator.

18. The rf power amplifier as set forth in claim 17 wherein said means for generating an electrical current comprises at least one triode tube having a cathode in signal contact with the second end of said resonating tube, and an anode in electrical contact with a high voltage power source.

19. The rf power amplifier as set forth in claim 18 further including a cathode plate in electrical contact with the cathode of said at least one triode tube and the second end of said resonating tube.

20. The rf power amplifier as set forth in claim 19 wherein said at least one triode tube includes a grid terminal electrically connected to a first reference potential.

21. The rf power amplifier as set forth in claim 20 further including a grid plate in electrical contact with said grid terminal and said body block, whereby said first reference potential to which said grid terminal is connected is the potential of said body block.

22. The rf power amplifier as set forth in claim 21 further including biasing means for biasing the cathode of said at least one triode tube at a second reference potential.

23. The rf power amplifier as set forth in claim 22 wherein the anode of said at least one triode tube is electrically connected to an anode block, and said anode block is electrically connected to an anode ring surrounding said anode block by means of said conductor means, said anode ring being sized to slide inside of said bore without making physical contact therewith, said conductor means including a conductive member formed in a loop that joins said anode cap to said anode ring, said loop being formed to enter a region of said linear accelerator.

24. The rf power amplifier as set forth in claim 23 further including electrical insulation means for preventing physical contact between said anode ring and the bore of said body block.

25. The rf power amplifier as set forth in claim 24 wherein said electrical insulation means comprises a dielectric cup adapted to fit around said anode ring, said anode ring, dielectric cup, and bore functioning as a capacitor, said capacitor comprising part of said electrical return path through which said high power electrical current returns to said first reference potential.

26. The rf power amplifier as set forth in claim 25 further including cooling means for removing heat from the anode and anode cap of said at least one triode tube.

27. The rf power amplifier as set forth in claim 26 wherein said conductive member of said conductor means comprises a metallic tube, and wherein said cooling means includes means for pumping a fluid through said metallic tube.

28. The rf power amplifier as set forth in claim 17 wherein said means for generating an electrical current comprises a pair of triode tubes mounted to said anode cap.

29. The rf power amplifier as set forth in claim 17 wherein said means for generating an electrical current comprises four triode tubes mounted to said anode cap.

30. The rf power amplifier as set forth in claim 17 further including adjustment means for adjusting the position of said means for receiving an input rf signal relative to the first end of said resonant tube, whereby said resonant tube may be selectively tuned to provide a desired magnitude for an output rf signal available at its second end.

31. A method of coupling rf high power to a linear accelerator, said linear accelerator being housed within a vacuum housing, said method comprising the steps of:

(a) mounting at least one triode tube in close physical and electrical proximity to said linear accelerator within said vacuum housing;

(b) connecting an anode of said at least one triode tube to a high voltage potential and to a first end of a conductor formed in a loop;

(c) connecting a second end of said conductor to one side of a capacitor, and connecting the other side of said capacitor to ground potential;

(d) connecting a grid of said at least one triode tube to ground potential;

(e) biasing a cathode of said at least one triode tube to a prescribed potential;

(f) positioning said loop of said conductor within a desired region of said linear accelerator so that an electrical current flowing through said conductor generates a magnetic field within said linear accelerator;

(g) generating a low level rf power signal external to said vacuum housing;

(h) coupling said low level rf power signal into said vacuum housing through an rf signal feedthrough connector; and (i) driving the cathode of said at least one triode tube with said low level rf power signal;

whereby a high power rf electrical current is generated that flows from the anode of said at least one triode tube through said conductor and capacitor to ground, generating a magnetic field that powers said linear accelerator.

32. The method as set forth in claim 31 wherein step (h) includes exciting a resonant cavity within said vacuum housing with said low level rf power signal, and coupling an output signal from said resonant cavity to the cathode of said at least one triode tube.

33. The method as set forth in claim 31, wherein step (c) includes connecting the second end of said conductor to an anode ring; surrounding the anode of said at least one triode tube, with said anode ring; surrounding said anode ring with a dielectric insulating cup; and placing said anode ring and insulating cup in a bore of a grounded metallic block; said anode ring, insulating cup and metallic block forming said capacitor.

* * * * *